US005469461A

United States Patent [19]

Andrea

[11] Patent Number: 5,469,461

[45] Date of Patent: Nov. 21, 1995

[54] ELECTRIC INDUCTION FURNACE

[76] Inventor: Martin Andrea, 2813 R.F.D., Long Grove, Ill. 60047

[21] Appl. No.: 41,671

[22] Filed: Apr. 1, 1993

[51] Int. Cl.[6] ..... H05B 6/24

[52] U.S. Cl. ..... 373/156; 373/151; 373/163

[58] Field of Search ..... 373/138, 142, 373/143, 151, 145, 155, 156, 161, 162, 163; 75/10.14

[56] References Cited

U.S. PATENT DOCUMENTS

| | | | |
|---|---|---|---|
| 2,499,540 | 3/1950 | Tama | 373/163 |
| 2,650,255 | 8/1953 | Hogel et al. | 373/143 |
| 4,658,404 | 4/1987 | Sick et al. | 373/143 |

*Primary Examiner*—Tu Hoang

*Attorney, Agent, or Firm*—Fitch, Even, Tabin & Flannery

[57] ABSTRACT

An electric induction furnace for heating various electrically conductive materials includes a pair of concentric crucibles disposed at a predetermined angle relative to a horizontal axis. The orientation of the crucibles enables the induction furnace to be directly coupled to a horizontal mold while at the same time allows venting of trapped gases and impurities in the conductive material. The configuration of the furnace further enables the casting mold to be partially inserted into the furnace, reducing heat losses of the furnace and, in turn, operating costs and also enabling the temperature of the molten material at the mold entry point to be relatively accurately controlled in order to provide castings having relatively uniform mechanical properties. The double crucible design minimizes risk of damage to the surrounding electric induction coil and further reduces the cost of replacement of a worn crucible.

3 Claims, 7 Drawing Sheets

ELECTRIC INDUCTION FURNACE

BACKGROUND OF THE INVENTION

1. Field of the Invention

The present invention relates to an electric induction furnace and, more particularly, to an electric induction furnace for heating various electrically conductive materials that is adapted to be directly connected to a horizontal mold, while at the same time allowing venting of trapped gases and impurities in the conductive material.

2. Description of the Prior Art

Electric induction furnaces are generally known in the art. Such furnaces are known to be used in various industries for melting various electrically conductive materials, such as brass. Such furnaces are also known to be used as holding furnaces for maintaining various materials in a molten state.

Electrical induction furnaces normally include a single crucible for holding an electrically conductive material and an electric coil; disposed about the crucible. A source of alternating current (AC) electric power is applied to the electric coil which, in turn, induces eddy currents in the electrically conductive material. The induced eddy currents flow in the electrically conductive material to cause internal resistance heating of the material as a result of the material's own resistivity.

The magnitude of the induced eddy currents and, hence, the heating of the electrically conductive material is directly proportional to the square root of the material's resistivity $\rho$ and inversely proportional to the material's permeability $\mu$ and frequency of the AC power applied to the electric coil. Thus, the frequency of the AC power applied to the electric coil is selected according to the particular application as well as the properties of the electrically conductive material. For applications for holding furnaces, frequencies between 20 and 300 Hz are known to be used.

Various configurations of such electric induction furnaces are known. In particular, these configurations relate to the orientation of the longitudinal axis of the crucible used for holding the electrically conductive material. In particular, both vertical and horizontal orientations of the crucibles are known. The orientation of the crucible is selected in accordance with the particular process in which it is to be used. For example, in applications where the electric induction furnace is to be used in conjunction with a horizontal casting operation, furnaces with horizontally oriented crucibles are normally selected. However, there are certain problems known to exist with such electric induction furnaces having horizontally oriented crucibles. In particular, the induced eddy currents are known to cause turbulence within the electrically conductive material which effectively creates a type of stirring action within the crucible. Although such stirring action is generally desirable; in furnaces having horizontally configured crucibles, such action also can cause gases to be trapped within the electrically conductive material which can result in voids in the resulting casting.

In addition, there are other problems with some known electric induction furnaces. In particular, in a typical casting operation, a casting mold is normally directly secured to a mounting flange on the holding furnace. In some known applications, changing of casting molds has been known to be relatively difficult.

There are also other problems with known electrical induction furnaces. In particular, as mentioned above, the casting molds are normally secured to a mounting flange on the outside of the furnace. Such an arrangement results in heat loss making the cost of producing the casted products more expensive. In addition, with such an arrangement, it is relatively difficult to control the temperature of the molten material at the mold entry point which can affect the mechanical properties of the resulting casting and result in non-uniform castings.

In addition, such furnaces are known to utilize a single crucible. In the event that this crucible cracks while holding a molten material, the surrounding electrical coil can be damaged. In addition, such crucibles are known to wear and require replacement. Replacement of a crucible in an electric induction furnace having a single crucible is known to be relatively expensive.

SUMMARY

It is an object of the present invention to solve various problems known in the prior art.

It is yet another object of the present invention to provide an electric induction furnace that is suitable for use in a horizontal casting operation.

It is yet a further object of the present invention to provide an electric induction furnace which provides means for venting trapped gases and impurities in the conductive material.

It is yet another object of the present invention to provide an electric induction furnace which allows for relatively quick and easy changing of casting molds.

It is yet a further object of the present invention to provide an electric induction furnace which provides for relatively constant temperature of the molten material at the mold entry point.

It is yet another object of the present invention to provide an electric induction furnace that is relatively less expensive to operate.

It is yet a further object of the present invention to provide an electrical induction furnace which minimizes the risk of damage to the electric induction coil.

It is another object of the present invention to reduce the cost of replacing worn crucibles.

Briefly, the present invention relates to an electric induction furnace for heating various electrically conductive materials which includes a pair of concentric crucibles disposed at a predetermined angle relative to a horizontal axis. The orientation of the crucibles enables the induction furnace to be directly coupled to a horizontal mold while at the same time allows venting of trapped gases and impurities in the electrically conductive material. The configuration of the furnace further enables the casting mold to be partially inserted into the furnace, reducing heat losses of the furnace and, in turn, reducing operating costs and also enabling the temperature of the molten material at the mold entry point to be relatively accurately controlled in order to provide castings having relatively uniform mechanical properties. The double crucible design minimizes risk of damage to the surrounding electric induction coil and further reduces the cost of replacement of a worn crucible.

BRIEF DESCRIPTION OF THE DRAWING

These and other objects of the present invention will become readily understood with reference to the following specification and attached drawing, wherein.

DETAILED DESCRIPTION OF THE PREFERRED EMBODIMENT

Figure 1:
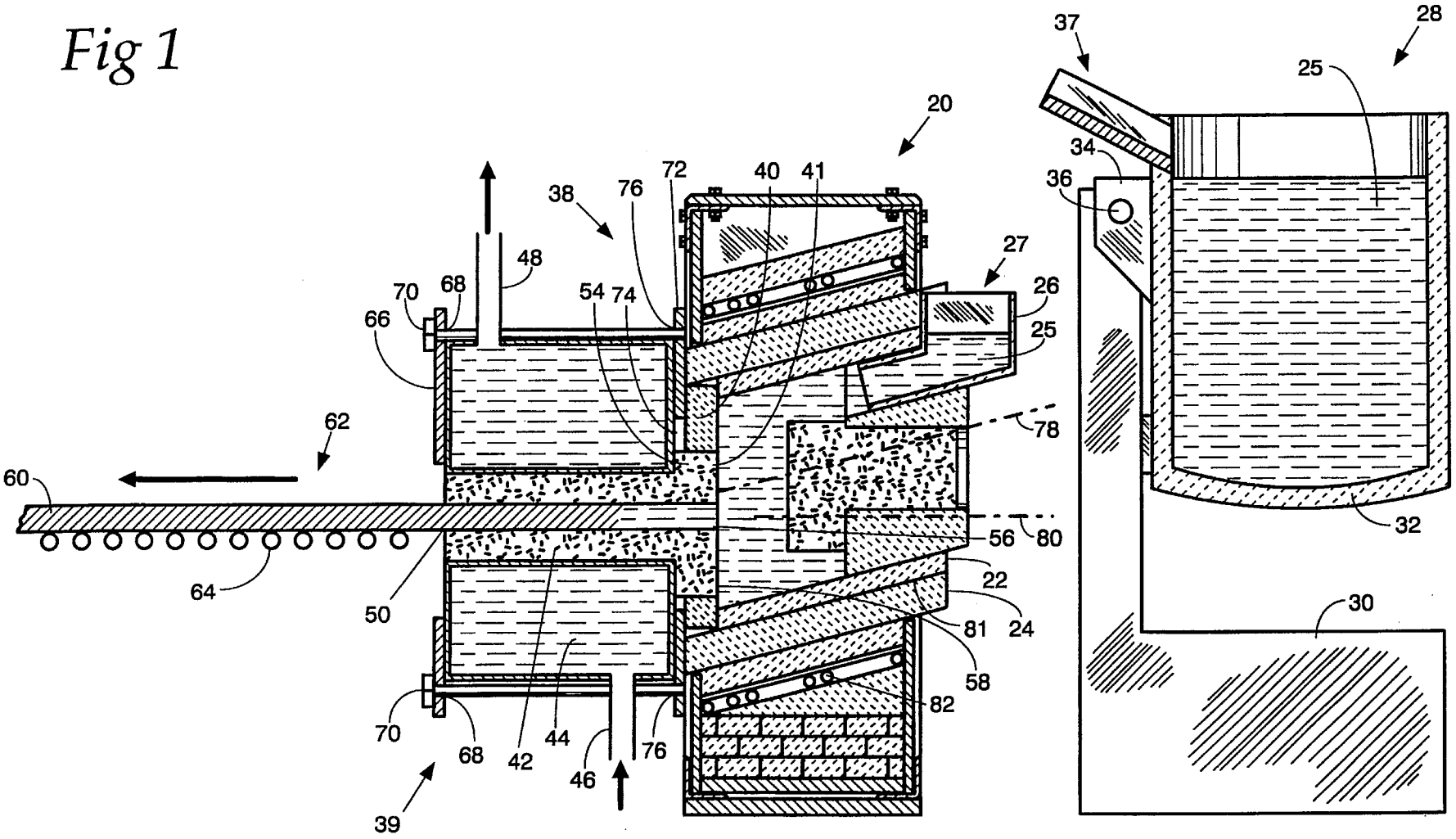
FIG. 1 is a side elevational view, in section, of an electric induction furnace in accordance with the present invention, shown in a typical application as a holding furnace, rigidly secured to a casting mold assembly and disposed downstream from a melting furnace with a pivotable crucible.
Figure 2:
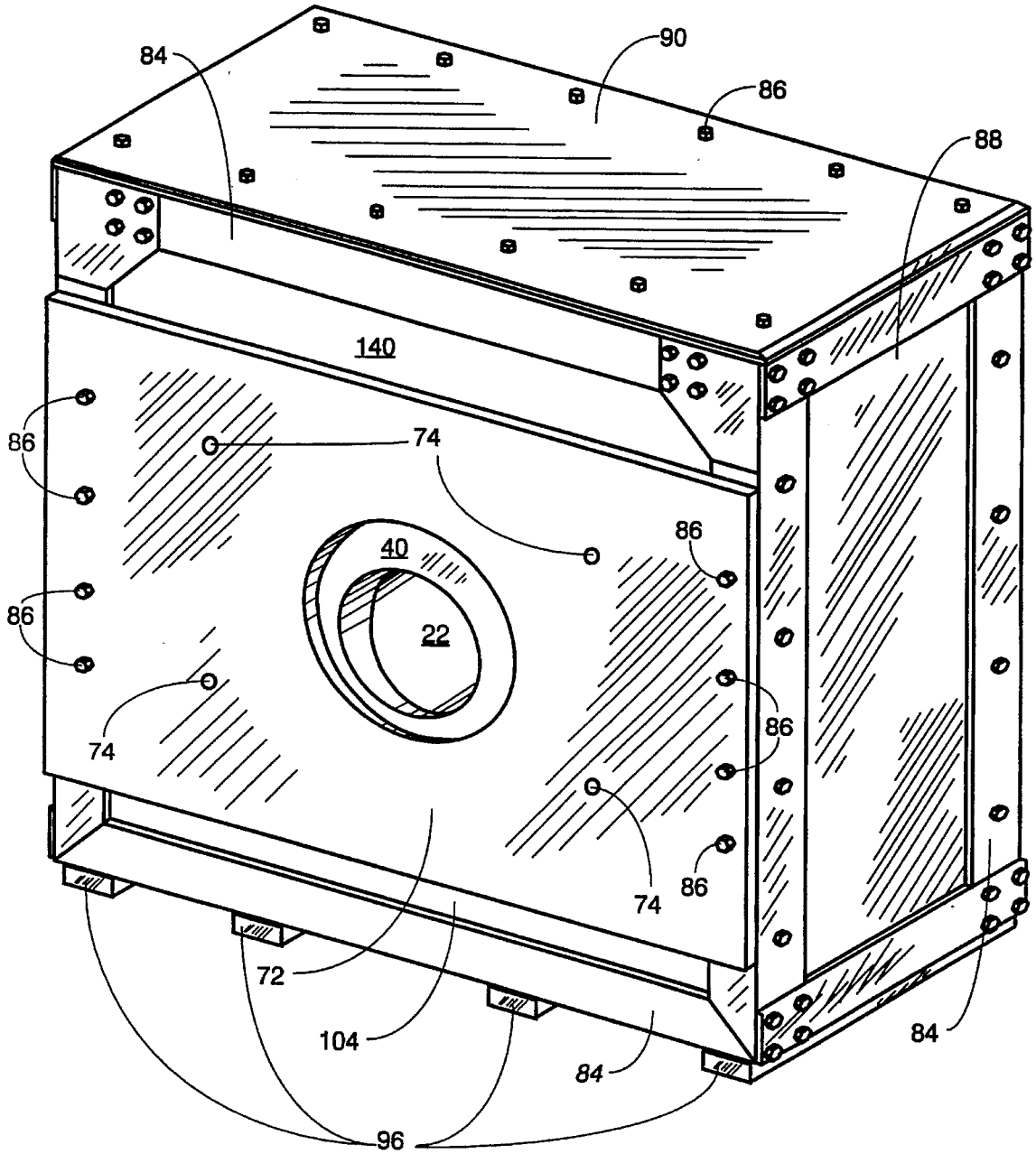
FIG. 2 is a perspective view of one embodiment of an electric induction furnace in accordance with the present invention.

The present invention relates to an electric induction furnace, suitable for use in horizontal casting applications. As shown and described herein, the electric induction furnace in accordance with the present invention, generally identified with the reference numeral 20, is used as a holding furnace in a casting operation for maintaining an electrically conductive material in a molten state.

With reference to FIG. 1, the electric induction furnace 20 includes a pair of concentric crucibles, defining an inner crucible 22 and an outer crucible 24, for holding molten material 25. The electric induction furnace 20 further includes an inlet spout 26, disposed on an inlet side 27 of the furnace 20, which provides a fluid conduit to the inner crucible 22 from outside the furnace 20. In particular, the inlet spout 26 enables molten material 25 from an upstream melting furnace 28 to be transferred to the holding furnace 20.

The melting furnace 28 is not part of the present invention. It is known that such melting furnaces 28 may be electrically or gas heated and used for melting various materials into a molten state. Such a melting furnace 28 is shown in simplified form in FIG. 1 and includes a frame 30 and a pivotally mounted crucible 32. The crucible 32 includes a pair of outwardly extending flanges 34 which enable the crucible 32 to be pivotally mounted relative to the frame 30 by way of a pin 36. The crucible 32 also includes an extending pour spout 37, disposed adjacent the top of the crucible 32. The pour spout 37 enables the molten material 25 from the crucible 32 to be poured into the inlet spout 26 on the holding furnace 20.

An outlet end 38 of the holding furnace 20 is adapted to be connected to a horizontal die or mold assembly 39 which includes a generally horizontal die or mold 42 formed, for example, from a graphite material and includes a surrounding water jacket 44. The water jacket 44 includes a water inlet 46 and a water outlet 48 for providing cooling to the die 42 in order to solidify the molten material 25 before it exits a die outlet 50. The die 42, formed from a material, such as graphite, includes an extending portion 54 which carries and surrounds an inlet portion 56 of the die 42. The extending portion 54 along with the die inlet 56 are adapted to be received within a mouth 58 of the furnace 20. In particular, a vertical plate 40 is provided in the mouth 58 of the furnace and the die inlet 56. The plate 40, generally circular in shape, is disposed against the outlet end of the crucible 22 and has an opening 41 which receives the die inlet 56. By disposing the die inlet 56 within the mouth 58 of the furnace 20, the temperature of the molten material 25 entering the die inlet 56 can be controlled relatively uniformly.

There are other benefits of disposing the die inlet 56 inside the furnace 20. For example, such a configuration reduces heat loses from the furnace 20. In addition, it is known that the electric induction heating causes a stirring action of the molten material 25 within furnace 20. By disposing the die inlet 56 within the furnace 20, the benefit of the stirring action will be available at the die inlet 56 in order to improve the grain of the resulting casting.

As the partially solidified material or casting 60 exits the die outlet 50, it is carried by a conveyor system, generally identified with the reference numeral 62, which includes a plurality of rollers 64. A stepper device (not shown) is used to incrementally pull the casting 60 from the die outlet 50. In particular, the stepper device is known to be a reciprocally mounted device, adapted to pull the casting 60 away from the die outlet 50 during a forward stroke and return on a return stroke.

Another important aspect of the invention is the relative ease in which the die assembly 39 can be secured to the furnace 20. In particular, the die assembly 39 includes a mounting plate 66 disposed on an end opposite the end received within the mouth 58 of the furnace 20. The mounting plate 66 is provided with a plurality of unthreaded apertures 68. These unthreaded apertures are adapted to receive elongated fasteners 70 used to secure the die assembly 39 to the furnace 20 by way of clamping forces. In particular, as will be discussed in more detail below, the outlet end 38 of the furnace 20 includes a mounting plate 72. The mounting plate 72 includes a centrally disposed aperture 74 aligned with the mouth 58 of the furnace 20. The central aperture 74 is selected to enable the extending portion 54 of the die assembly 39 to be received within the mouth 58 of the furnace 20 through the opening 41 in the plate 40. In order to enable the die assembly 39 to be clamped to the furnace 20, the mounting plate 72 is provided with threaded apertures 76 for receiving the threaded fasteners 70. Such a configuration enables for relatively quick and easy changing of the die assembly 39.

Another important aspect of the invention is the configuration of the crucibles 22 and 24 which enables the furnace 20 to be used with horizontal die assemblies 39, while at the same time enabling gas bubbles and impurities to be vented. In particular, as discussed above, the furnace 20 includes an inner crucible 22 and an outer crucible 24. These crucibles 22 and 24 are disposed such that their longitudinal axis 78 is disposed at a predetermined angle relative to a horizontal axis 80; for example, an acute angle between 5°–75°. The angle between the longitudinal axis 78 of the crucibles 22 and 24 and the horizontal axis 80 creates a condition analogous to a holding furnace with a vertically oriented crucible which enables trapped gas bubbles to be vented while at the same time providing the ability of the furnace 20 to be utilized in a horizontal casting operation.

There are also other advantages of the crucible design in accordance with the present invention. First, the double crucible design reduces the cost of replacing a worn-out crucible. In particular, crucibles provided in induction furnaces are known to wear due to the known stirring action of the molten material 25 within the crucible. Known furnaces are provided with a single relatively expensive crucible. Thus, replacement costs of such a crucible are relatively expensive. The furnace 20 in accordance with the present invention solves this problem. In particular, referring to FIG. 1, for example, the molten material 25 is carried by the inner crucible 22. Thus, only the inner crucible 22 will wear and need replacement. Thus, the cost of replacement of the inner crucible 22 will be relatively less than the cost of a crucible from a furnace which only utilizes a single crucible. In addition, the replacement of the inner crucible 22 is relatively easier. More particularly, induction furnaces are known to include an electric coil wrapped around the crucible. The electric coil can make replacement of the crucible relatively difficult. In the present invention, since the electric coil is wrapped around the outer crucible 24, the electric coil has no effect on the replacement of the inner crucible 22.

The dual crucible design also provides other benefits. For example, the dual crucible design minimizes risk of damage to the electric coil in the event that the crucible develops cracks. In particular, in known furnaces, any crack in the crucible can result in damage to the surrounding electric coil, resulting from leakage of the molten material through the crack. In the present invention, risk of damage to the electric coil is minimized. In particular, during a condition when the inner crucible 22 develops a crack, the outer crucible 24 will prevent the molten material 25 from damaging the electrical coil. In addition, for additional protection, a sealer 81, for example, Inducto Backing #60-Dry, may be used between the inner and outer crucibles 22 and 24, respectively.

Figure 7:
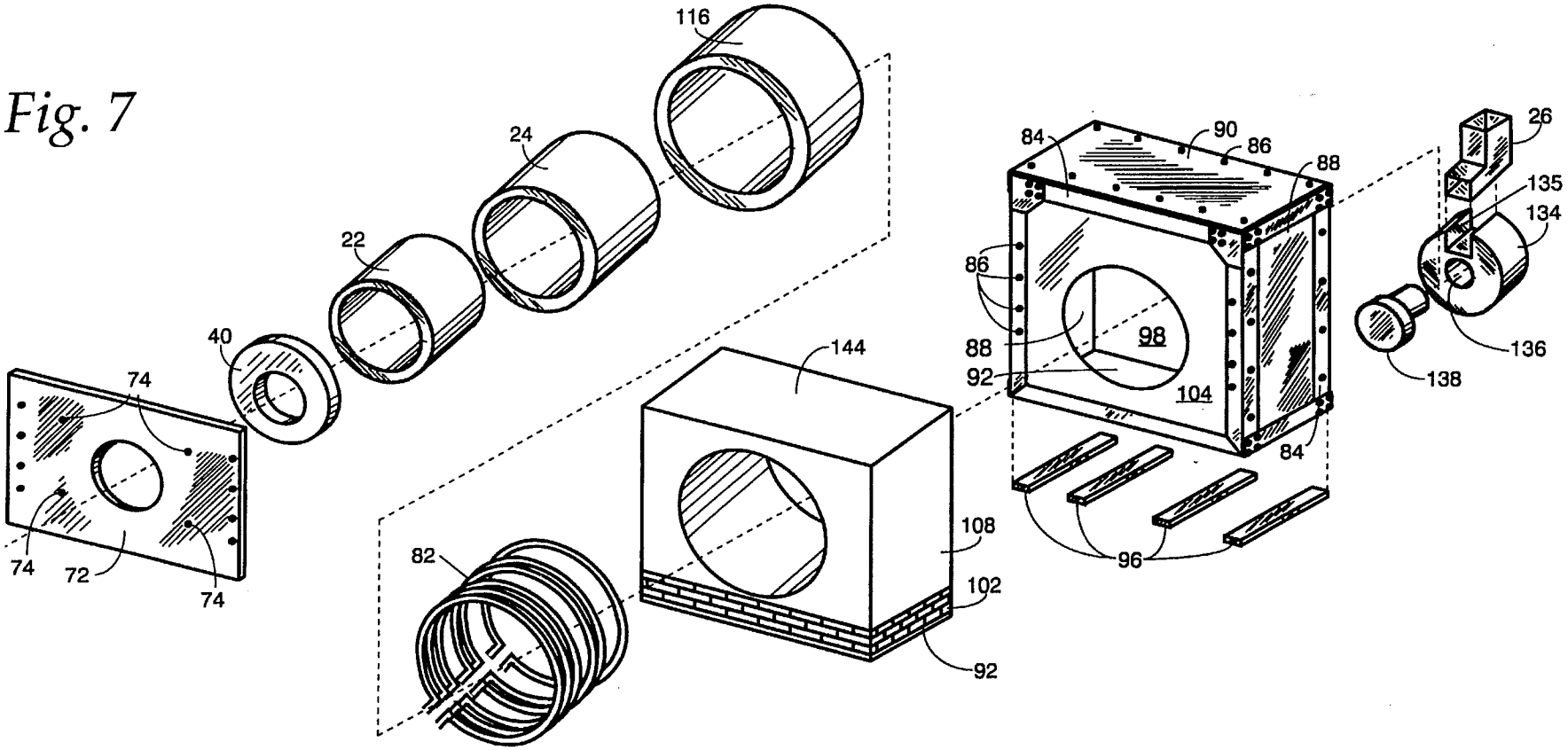
FIG. 7 is an exploded perspective view of the electric induction furnace illustrated in FIG. 2.
Figure 8:
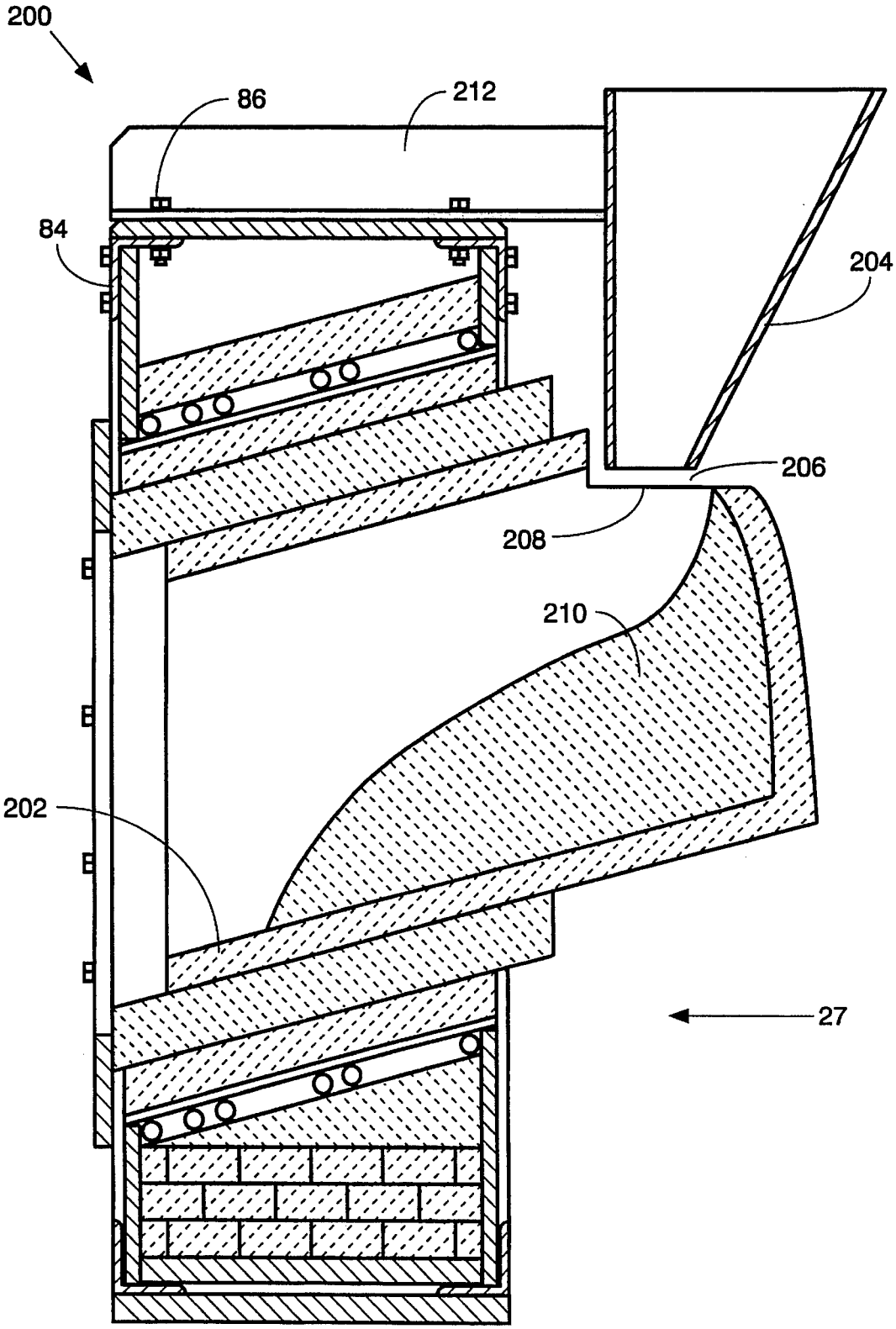
FIG. 8 is a side elevational view, in section, of an alternate embodiment of the electric induction furnace in accordance with the present invention.

Two embodiments incorporating the features of the electric induction furnace 20 in accordance with the present invention are described and illustrated. In particular, FIGS. 1–7 illustrate a first embodiment, while FIG. 8 illustrates an alternative embodiment.

Both embodiments of the invention rely on electrical induction for heating the molten material 25 within the inner crucible 22 or 202. In particular, the molten material 25 used in such a process must be an electrically conductive material, such as brass. When AC electrical power is applied to the electric coil 82, disposed around the outer crucible 24, eddy currents are induced in the molten material 25. Since such electrically conductive materials 25 have a predetermined resistivity, resistance heat is generated by the induced eddy currents within the molten material 25.

The electric coil 82 does not form part of the present invention. Such electric coils can be purchased, for example, from Inductotherm Corporation in Rancocas, N.J.

Referring to FIGS. 1–7, a first embodiment of the invention is illustrated. In particular, the furnace 20 includes a generally rectangular steel frame 84, formed from, for example, angle iron. As discussed above, a mounting plate 72 is provided. The mounting plate 72 may be secured to the frame 84 adjacent the furnace outlet end 38 of the furnace 20 by way of suitable fasteners 86. Such an arrangement enables the mounting plate 72 to be relatively easily removed for replacement of the inner crucible 22.

A pair of side plates 88 are provided and secured to the frame 84 by way of the fasteners 86. The top of the furnace 20 is closed with a top plate 90, secured to the frame 84 with the fasteners 86. A bottom plate 92 (FIG. 3) is carried by a pair of spaced apart bottom frame members 84. The bottom plate 92 forms a base for the furnace 20 as will be discussed in more detail below. In order to provide spacing between the bottom of the furnace and the floor, the bottom frame members 84 may be, in turn, supported by a plurality of elongated steel bars 96.

A rear plate 98 is provided and is secured to the frame 84. The rear plate 98 is configured to enable the inlet spout 26 as well as an extending portion 100 of the furnace 20 to extend outwardly from the inlet side 27 of the furnace 20. The rear plate 98 is formed in a generally rectangular shape with an eliptical opening which supports the entrance end of crucible 24.

The bottom of the furnace 20 is lined with a plurality of refractory bricks 102, for example, as available from Inductotherm Corporation, carried by the bottom plate 92. The refractory bricks 102 are disposed between a pair of spaced apart plates 104 and 98, disposed to be generally perpendicular to the bottom plate 92. The front plate 104 is shaped similarly to plate 98, except for the position of the eliptical opening. The lengths of the plates 104 and 98 differ. The position of the eliptical openings in plates 104 and 98 is selected in accordance with the desired angle of inclination of the longitudinal axis 78 of the crucibles 22 and 24 relative to the horizontal axis 80.

Figure 3:
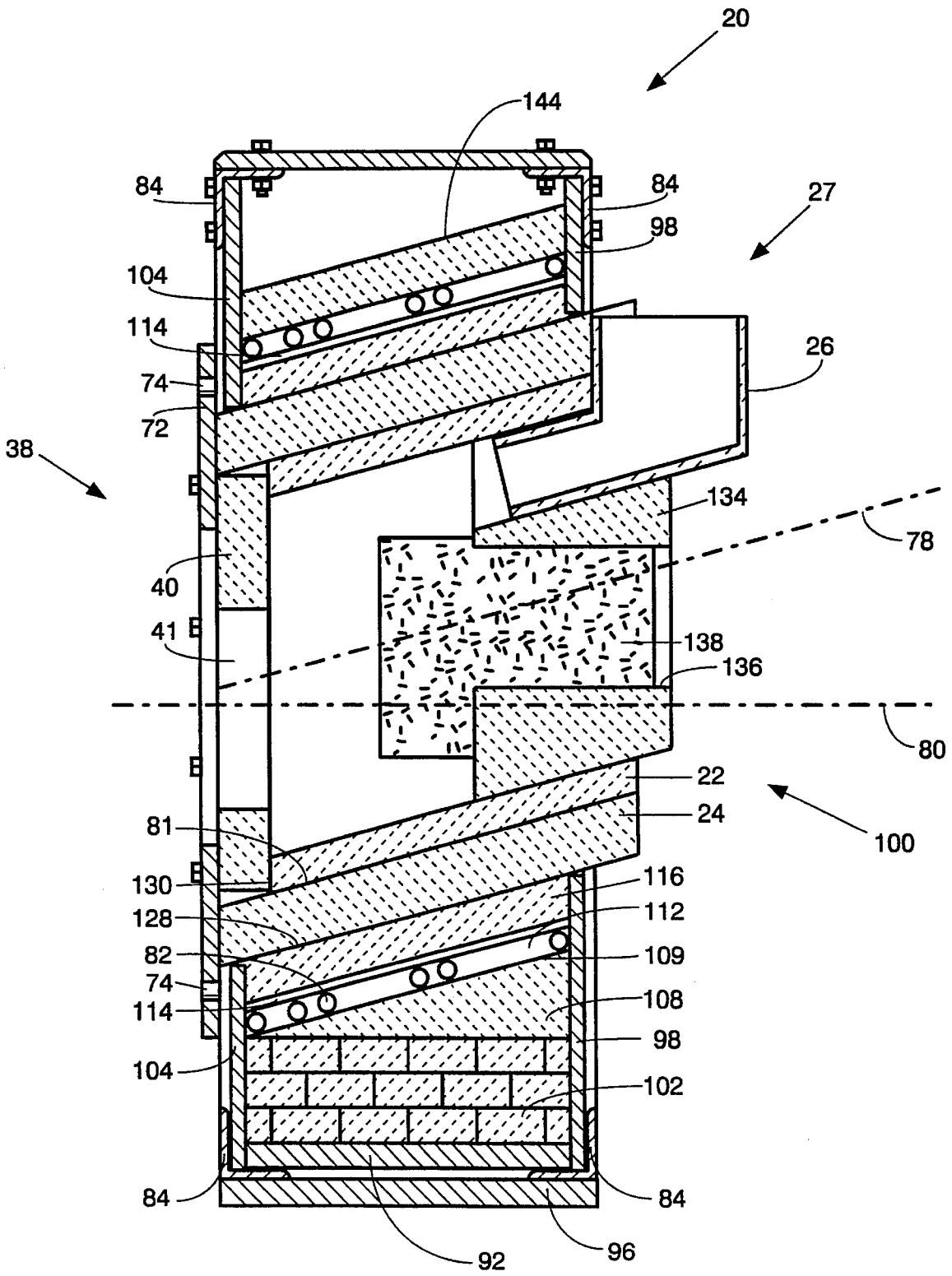
FIG. 3 is an elevational view, in section, of the electric induction furnace illustrated in FIG. 2.
Figure 4:
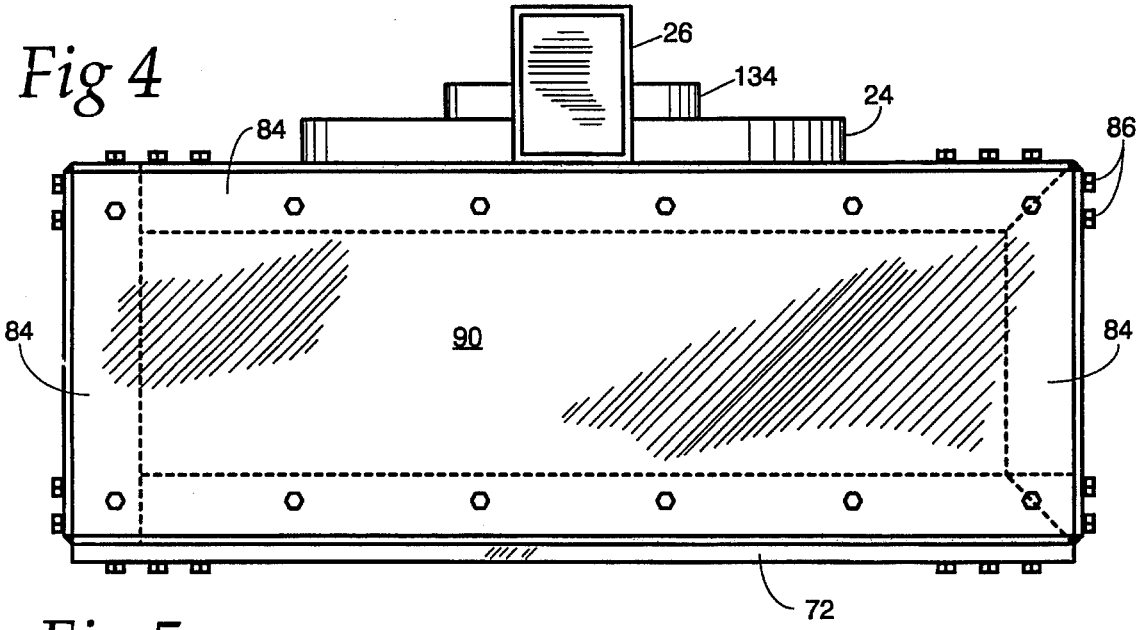
FIG. 4 is a top view of the electric induction furnace illustrated in FIG. 2.
Figure 5:
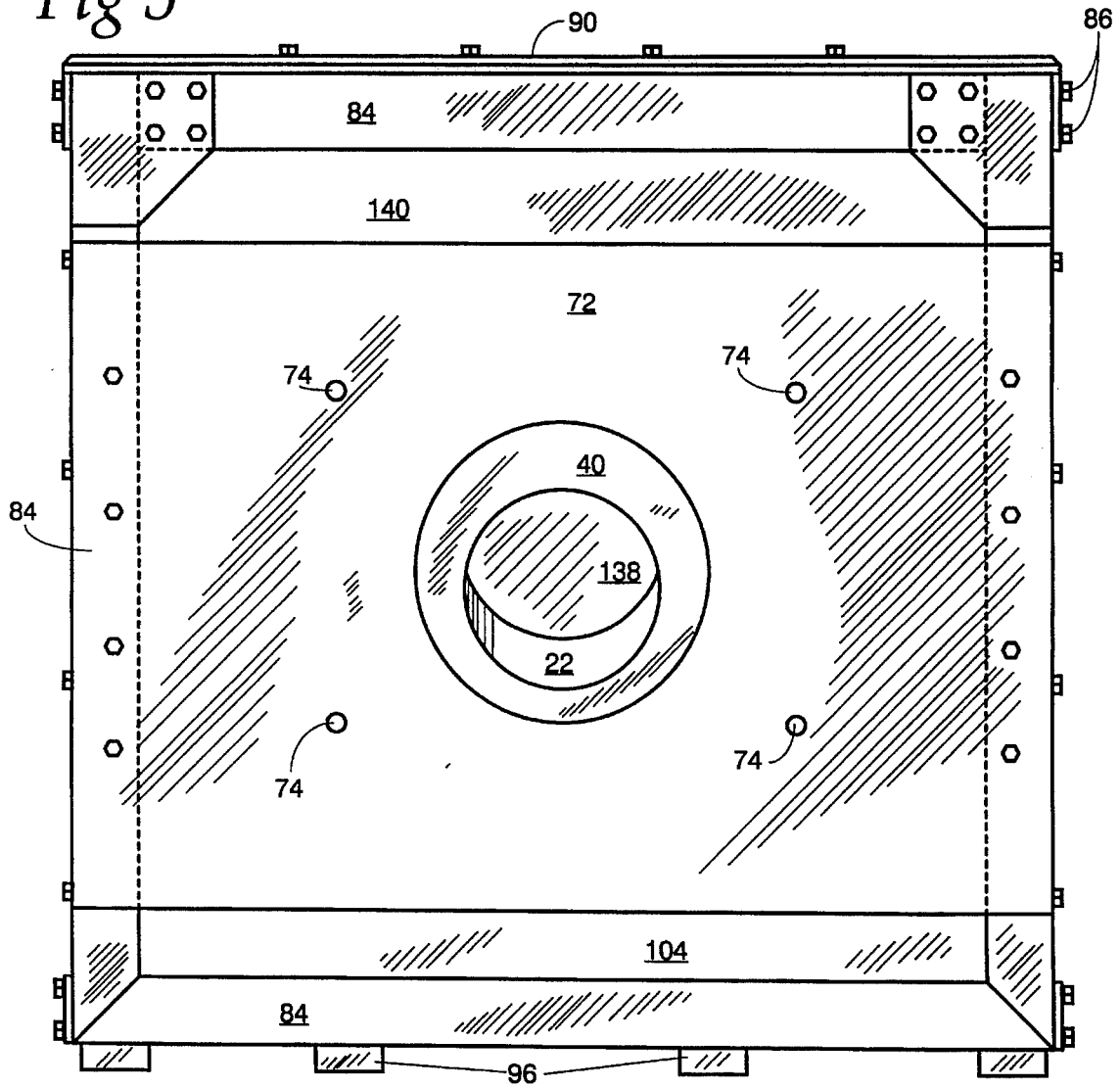
FIG. 5 is a front view of the electric induction furnace illustrated in FIG. 2.
Figure 6:
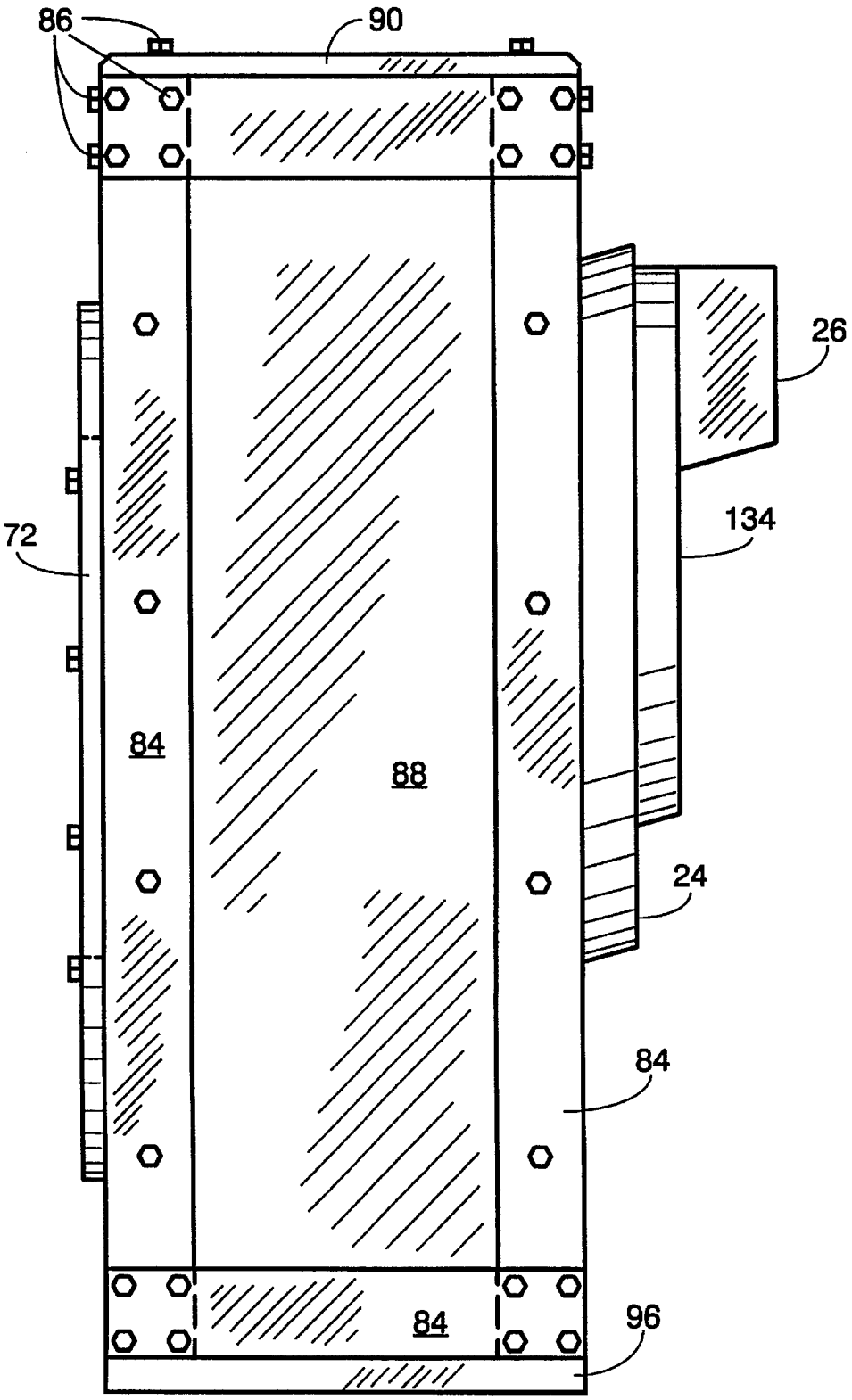
FIG. 6 is a side elevational view of the electric induction furnace illustrated in FIG. 2.

A refractory cast 108 is carried on top of a top layer of the refractory bricks 102. The refractory cast 108 may be purchased from Inductotherm Corporation, for example. As best shown in FIGS. 1, 3 and 7, the refractory cast 108 is formed in a generally rectangular shape with a centrally disposed aperture 109, disposed to be coaxial with longitudinal axis 78 which forms the desired angle of inclination with the horizontal axis 80. In addition, the refractory cast 108 may be formed with a top surface 144, sloped as indicated. The refractory cast 108 is disposed between the plates 104 and 98 with the diameter of the aperture 109, sized to be below the tops of the plates 104 and 98 in order to provide a cavity 112 for receiving the electric coil 82. A coil coat 114, such as Inducto-Seal No. 5 Ram Dry, is disposed about the electric coil 82. The electric coil 82 surrounds the crucibles 22 and 24.

A sealer, such as Inducto Back Nr. 60 Dry, forms a generally hollow cylinder 116 (FIG. 7) between a coil coat 114 and the crucible 24. This sealer 116 is a dry powder and is held in place by the front plate 104 and the back plate 98.

The crucibles 22 and 24 are formed as generally cylindrical members, open on both ends, and sized so that the inner crucible 22 fits within the outer crucible 24. The length of the inner crucible 22 is selected to be relatively shorter than the outer crucible 24 forming an annular shoulder 130 for receiving the extending portion 54 of the die assembly 39.

The crucibles 22 and 24 are formed of silicon carbide material. As mentioned above, in order to further minimize the risk of damage to the electric coil 82, a sealer Inducto Back Nr. 60 Dry may be disposed between the inner crucible 22 and the outer crucible 24.

The outer crucible 24 is received in the openings of plates 98 and 104. The outer crucible 24 extends to the mounting plate 72 on the outlet end 38 of the furnace 20 and extends outwardly from the rear plate 98 on the inlet end 27 of the furnace 20. The inner crucible 22 is disposed within the outer crucible 24 to be generally flush therewith on the inlet end 27 and to form the shoulder 130 on the outlet end 38.

A generally cylindrical closing member 134 is used to close the inner diameter of the inner crucible 22 on the inlet end 27 of the furnace. The closing member 134 is formed with an axial notch 135 for carrying the inlet spout 26; a generally hollow L-shaped member. The closing member 134 also includes a central bore 136. The central bore 136 is adapted to receive a plug 138, for example, a graphite plug, which closes one end of the bore 136 and thus the inner crucible 22 and also controls the available inner volume of the inner crucible 22.

An alternate embodiment of the furnace in accordance with the present invention is illustrated in FIG. 8, and generally identified with the reference numeral 200. For brevity, only those portions that are different from the first embodiment illustrated in FIGS. 1–7, will be described. However, the same reference numerals are used for like elements. In this embodiment, the differences relate to the configurations of the inner crucible 202 and the inlet spout 204, as well as the means for securing the inlet spout 204 to the furnace 200.

In particular, in this embodiment, the inner crucible 202 is formed as a generally hollow, cylindrical member, closed on one end adjacent the inlet side 27 of the furnace 200. A irregularly shaped portion 206 of the crucible 202 is removed to provide an inlet opening 208 to the furnace 200. Instead of the cylindrical member 134 and the plug 138, the inner volume of the inner crucible 202 may be controlled by applying a rammed lining material 210 shown in an irregular shape within the inner crucible 202.

Moreover, the inlet spout 204 is formed to be generally funnel shaped and is secured at one end to a bracket 212. The bracket 212 is secured by suitable fasteners 86 to the frame 84. The bracket 212 is configured such that the inlet spout 204 is aligned with the inlet opening 208 in the inner crucible 202.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An electric induction furnace having a horizontal axis which includes an electric coil for heating predetermined electrically conductive materials by induction, the improvement comprising:

a first crucible adapted to carry said predetermined electrically conductive materials defining a predetermined longitudinal axis;

a second crucible disposed generally concentrically around and in contact with said first crucible for carrying said first crucible, said first and second crucibles formed from at least one refractory-type material; and means for rigidly carrying said first and second crucibles such that said predetermined longitudinal axis is disposed at a predetermined angle relative to said horizontal axis.

2. An electric induction furnace as recited in claim 1 wherein said predetermined angle is an acute angle.

3. An electric induction furnace as recited in claim 2, wherein said predetermined acute angle is in the range of 5°–75°.

* * * * *